US007033012B2

(12) United States Patent
Diaz-Felipe

(10) Patent No.: US 7,033,012 B2
(45) Date of Patent: Apr. 25, 2006

(54) INK CONTAINMENT APPARATUS AND METHODS FOR INKJET PRINTERS

(75) Inventor: Ricardo G. Diaz-Felipe, Aquadilla, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 64 days.

(21) Appl. No.: 10/356,784

(22) Filed: Jan. 31, 2003

(65) Prior Publication Data

US 2004/0150695 A1 Aug. 5, 2004

(51) Int. Cl.
*B41J 2/175* (2006.01)

(52) U.S. Cl. ..... 347/87

(58) Field of Classification Search ..... 347/85, 347/84, 86–87, 15, 43, 46
See application file for complete search history.

(56) References Cited

U.S. PATENT DOCUMENTS 4,635,078 A * 1/1987 Sakurada et al. ..... 347/15
4,952,942 A * 8/1990 Kanome et al. ..... 347/15
5,025,271 A * 6/1991 Baker et al. ..... 347/87
5,280,300 A * 1/1994 Fong et al. ..... 347/87
5,440,327 A * 8/1995 Stevens ..... 346/46
6,130,686 A * 10/2000 Danzuka et al. ..... 347/43
6,206,511 B1 * 3/2001 Cook et al. ..... 347/85
6,283,585 B1 * 9/2001 Ikkatai et al. ..... 347/85
6,345,891 B1 * 2/2002 Childers et al. ..... 347/87
6,540,327 B1 * 4/2003 Akiyama et al. ..... 347/43
6,540,340 B1 * 4/2003 Thorpe et al. ..... 347/85

* cited by examiner

*Primary Examiner*—K. Feggins

(57) ABSTRACT

Apparatus include an inkjet pen with a body that defines a first ink reservoir configured to contain a first ink, and a second ink reservoir configured to contain a second ink. A print head is also included, and is operatively supported by the body, wherein the first ink reservoir and the second ink reservoir are each selectively connectible in fluidic communication with the print head. Methods of providing ink for an imaging process include providing an inkjet pen with a first ink reservoir and a second ink reservoir. A first ink with a relatively high color saturation of a given color is placed into the first ink reservoir. A second ink with a relatively low color saturation of the given color is placed into the second ink reservoir.

10 Claims, 4 Drawing Sheets

INK CONTAINMENT APPARATUS AND METHODS FOR INKJET PRINTERS

BACKGROUND OF THE INVENTION

Thermal inkjet imaging devices, such as "inkjet printers," are generally well known in the art. Typical inkjet printers include a main chassis that supports a media conveying system and a pen traversing system, as well as a control system for controlling various operational functions of the printer. The media conveying system is configured to consecutively move imaging media, such as sheets of paper, past the pen traversing system.

The pen traversing system is configured to support one or more inkjet pens, and to move the pen(s) transversally across the media so that the pen(s) can project ink onto the media in desired locations to form an image. The combination of the movement of the media in a given direction by the media conveying system and the movement of the pen(s) transverse to the given direction by the pen traversing system enables the printer to produce virtually any two-dimensional image on the media.

A typical inkjet pen generally includes a body that defines and/or encloses an ink reservoir. Supported on the inkjet pen body is a print head that, in turn, includes an orifice plate. A plurality of small orifices are defined in the orifice plate. The print head generally includes a series of small heating elements that can be precisely and selectively controlled. Each heating element is typically associated with a given orifice, whereby the heater is activated to nearly instantaneously vaporize a quantity of ink near the given orifice, causing a droplet of ink to be projected from the orifice and onto the media. In this manner, an image can be produced on the media. Such means of projecting ink onto an image carrier is generally known as piezo-electric or thermal print head technology. However, it is understood that other means of printing are known.

Typically, conventional inkjet printers are capable of producing color images in addition to black and white text. It is known that by selectively applying one or more of four basic colors of ink to the media in various manners, a substantially broad spectrum of image colors can be produced. The four colors thus generally employed are those of yellow, cyan, magenta, and black (it is understood for the purposes of this discussion that "black" is considered to be a color).

Subsequent to the initial development of the color inkjet printer it was discovered that by employing reduced concentrations of ink color, the quality of the image produced could be significantly improved, especially when reproducing color photographs and the like. For example, typically the ink colors of light cyan and light magenta are used in place of regular cyan and regular magenta, respectively, for producing higher-quality images.

SUMMARY OF THE INVENTION

In accordance with one embodiment of the present invention, an inkjet pen, includes a body that defines a first ink reservoir and a second ink reservoir. The first ink reservoir is configured to contain a first ink, and the second ink reservoir configured to contain a second ink. The inkjet pen also includes a print head that is operatively supported by the body, wherein the first ink reservoir and the second ink reservoir are each selectively connectible in fluidic communication with the print head.

In accordance with another embodiment of the present invention, a method of providing ink for an imaging process, includes providing an inkjet pen that defines a first ink reservoir and a second ink reservoir. A first ink is provided which has a relatively high color saturation of a given color. The first ink is placed into the first ink reservoir. A second ink is also provided and is placed into the second ink reservoir. The second ink has a relatively low color saturation of the given color. A print nozzle orifice can also be included. The method can further include selectively supplying either the first ink or the second ink to the print nozzle orifice.

DETAILED DESCRIPTION OF THE INVENTION

Various embodiments of the present invention generally include an inkjet pen with a body that defines a plurality of ink reservoirs. A print head can be operatively supported by the body, and a print nozzle orifice can be defined on the print head. At least two of the ink reservoirs can be selectively connectible in mutually exclusive fluidic communication with the print nozzle orifice. In this manner, a first ink can be contained in one of the ink reservoirs while a second ink can be contained in another of the in reservoirs. The first ink car thus be selectively supplied to the ink nozzle orifice to the exclusion of the second ink. Alternatively, the second ink can be selectively supplied to the ink nozzle orifice to the exclusion of the first ink.

Figure 1:
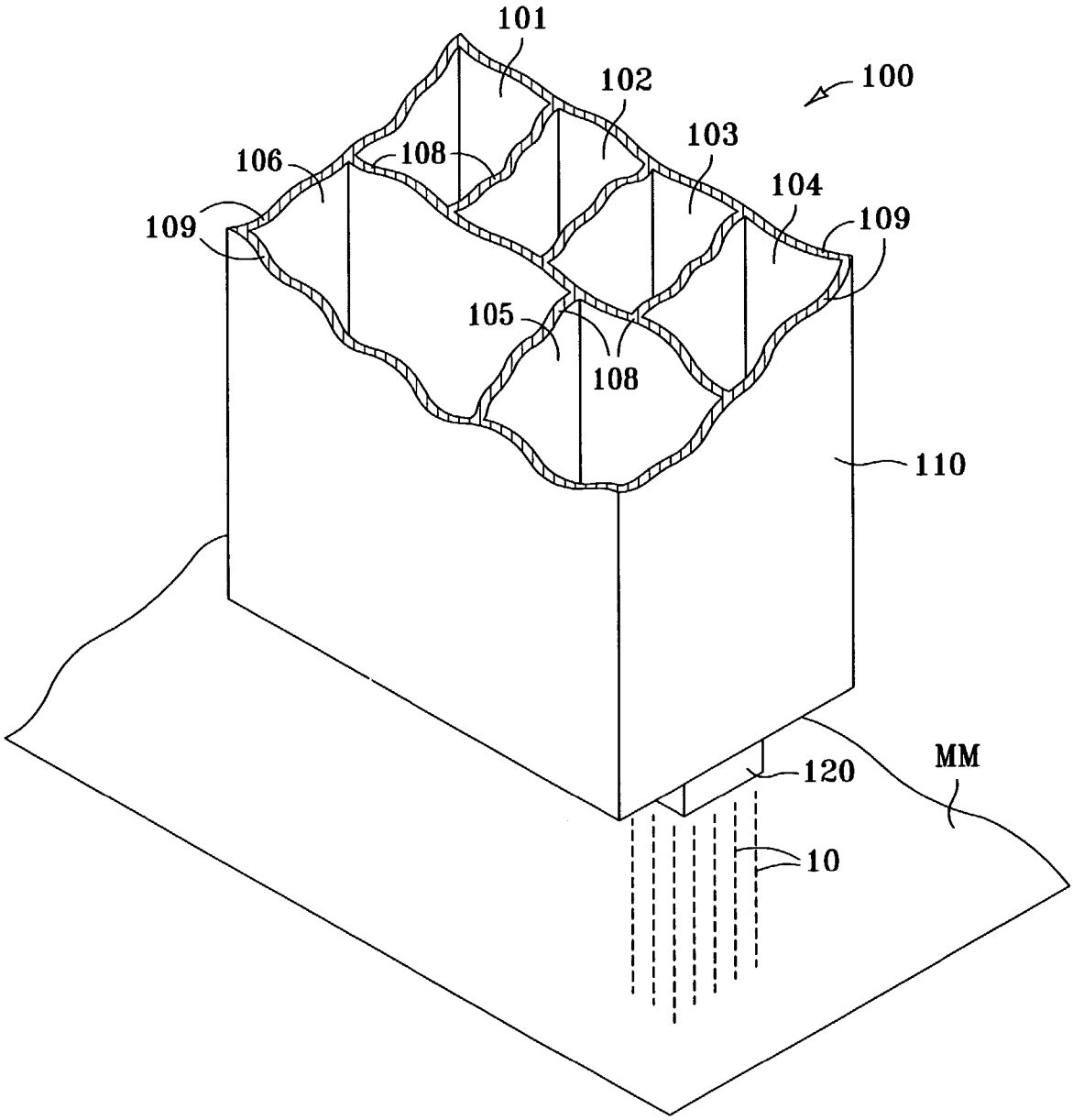
FIG. 1 is an isometric view in which an inkjet pen is depicted in accordance with one embodiment of the present invention.

With reference now to FIG. 1, an isometric view is shown in which an inkjet pen 100 is depicted in accordance with one embodiment of the present invention. The ink-jet pen 100 includes a pen body 110 that is configured to contain a quantity of ink (not shown). The pen body 110 can be divided into a plurality of ink reservoirs or chambers as is depicted. More specifically, the body 110 can include an outer wall 108 as well as at least one partition, or inner dividing wall 109, so as to form a plurality of reservoirs or chambers.

By way of example only, the outer wall 108 and the inner walls 109 can be arranged the manner depicted wherein the body 110 defines therein a first ink reservoir 101 and a second ink reservoir 102. Furthermore, a third ink reservoir 103 and a fourth ink reservoir 104 can also be defined by the body 110, as can be a fifth ink reservoir 105 and a sixth ink reservoir 106. Each of the ink reservoirs defined by the body 110 can be configured to contain a specific associated ink.

That is, still referring to FIG. 1, the first ink reservoir 101 can be configured to contain a first ink (not shown), while the second ink reservoir 102 can be configured to contain a second ink (not shown). Likewise, the third ink reservoir 103 can be configured to contain a third ink (not shown), while the fourth ink reservoir can be configured to contain a fourth ink (not shown). In a similar manner, the fifth ink reservoir 105 and the sixth ink reservoir 106 can each be configured to contain a fifth ink (not shown) and a sixth ink (not shown), respectively.

The inkjet pen 100 can also include a print head 120. The print head 120 can be operatively supported on the body 110 as is depicted. The print head 120 can be configured to receive an associated ink from one or more of the ink reservoirs 101, 102, 103, 104, 105, 106, and can be further configured to selectively project droplets 10 of one or more of the inks onto an image-carrier such as a sheet of media MM in a predetermined pattern so as to form an image thereon. Print heads, such as the print head 120, and their operation are well known in the art and need not be discussed in further detail herein.

It is understood, with continued reference to FIG. 1, that the pen body 110 need not necessarily be of a unitary-type construction. That is, each of the ink reservoirs 101, 102, 103, 104, 105, 106 need not be integral with a single-piece body. To the contrary, the term "body" as used herein is intended to include not only unitary bodies, such as the body 110 as is illustrated by way of example, but also bodies which are not specifically illustrated herein which comprise one or more vessels or the like in each of which one or more of the ink reservoirs 101, 102, 103, 104, 105, 106 are defined, and wherein such vessels, when assembled together, make up the pen body.

Figure 2:
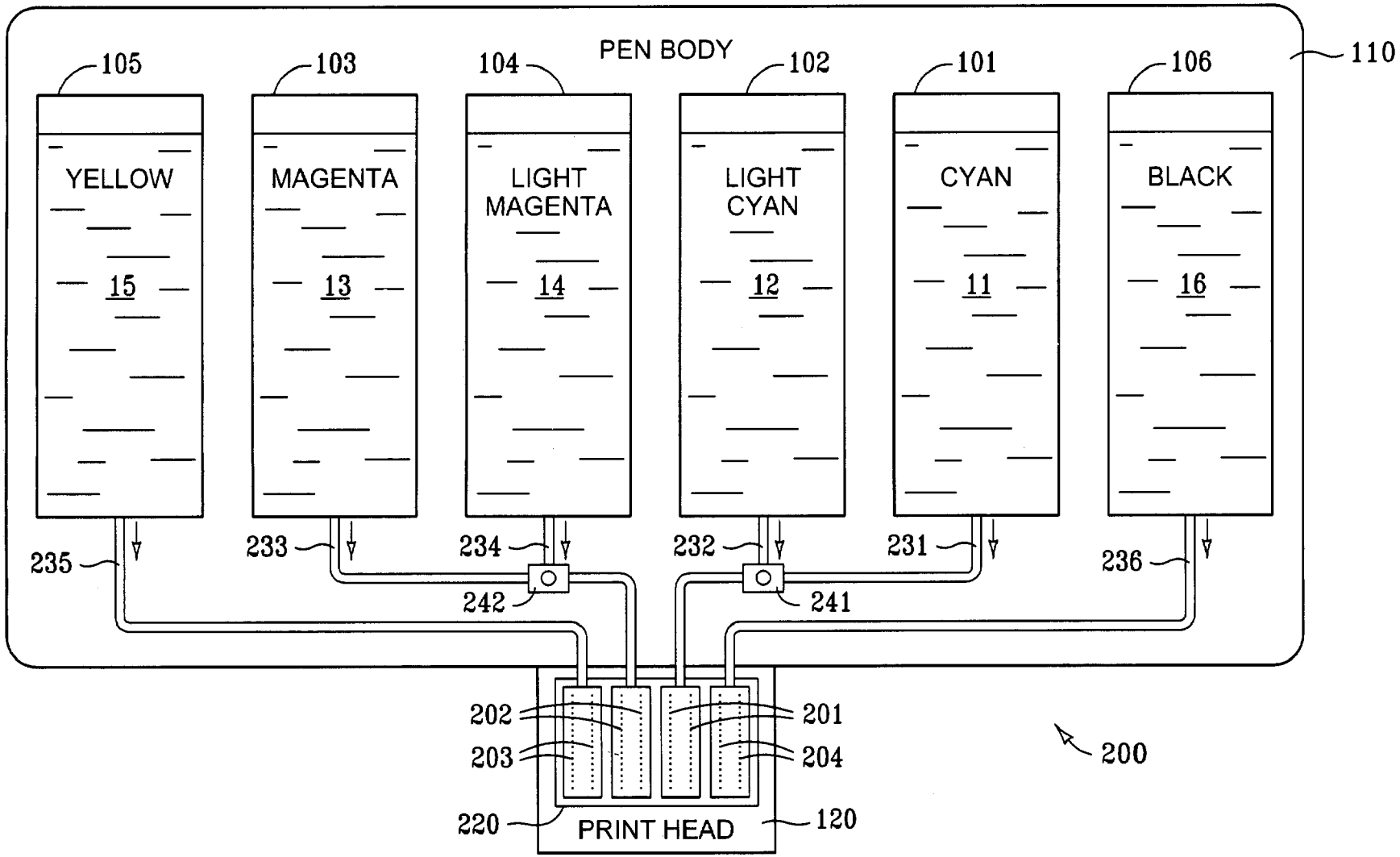
FIG. 2 is a schematic diagram in which an inkjet pen is depicted in accordance with another embodiment of the present invention.

Turning now to FIG. 2, a schematic diagram is shown in which an inkjet pen 200 is depicted in accordance with another embodiment of the present invention. As can be appreciated, the pen 200, which is schematically represented in FIG. 2, can be substantially similar to the pen 100 that is shown in FIG. 1 and is described above with respect thereto. That is, still referring to FIG. 2, the pen 200 can include a plurality of ink reservoirs that are each configured to contain an associated ink.

More specifically, the ink jet pen 200 includes a body 110 that is described above with respect to the inkjet pen 100. The inkjet pen 200 can also include a print head 120 that is also described above with respect to the inkjet pen 100. As is described above, the body 110 can define therein one or more ink reservoirs such as the first ink reservoir 101, the second ink reservoir 102, the third ink reservoir 103, the fourth ink reservoir 104, the fifth ink reservoir 105, and the sixth ink reservoir 106.

As is mentioned above, each of the ink reservoirs 101, 102, 103, 104, 105, 106 can include, and/or be configured to contain, an associated ink. For example, the first ink reservoir 101 can include, and/or be configured to contain, a first ink 11, and the second ink reservoir 102 can include, and/or be configured to contain, a second ink 12. Likewise, the third ink reservoir 103 can include, and/or be configured to contain, a third ink 13, while the fourth ink reservoir 104, the fifth ink reservoir 105, and the sixth ink reservoir 106 can each include, and/or be configured to contain, a fourth ink 14, a fifth ink 15, and a sixth ink 16, respectively. Each of the inks 11, 12, 13, 14, 15, 16 can have an associated color. That is, each of the inks 11, 12, 13, 14, 15, 16 can be an exclusive, or different, color.

It is understood that each of the ink reservoirs 101, 102, 103, 104, 105, 106 need not be associated with a specific color. However, the first ink 11 can be related to the second ink in at least one respect. Similarly, the third ink 13 and the fourth ink 14 can be related to one another in at least one respect. More specifically, the first ink 11 can have a first concentration of a given color pigmentation while the second ink 12 has a second concentration of the given color pigmentation. Stated in a different manner, the first ink 11 can be of a first color saturation of a given color hue, while the second ink 12 is of a second color saturation of the given color hue.

For example, the given color pigmentation, or hue, can be cyan. Furthermore, the first concentration, or saturation, can be relatively heavy, while the second concentration, or saturation, can be relatively light. In that instance, the first ink 11 can be a regular cyan color, while the second ink 12 can be a light cyan color. Thus, a relatively heavy concentration, or saturation of a given color pigmentation, or hue, can generally result in a more vivid representation of the given color, while a relatively light concentration, or saturation, of the given color pigmentation, or hue, can generally result in a less vivid representation of the given color.

As is explained above, the inkjet pen 100 can include the third ink reservoir 103 and the fourth ink reservoir 104, in addition to the first ink reservoir 101 and the second ink reservoir 102. In that instance, the first ink 11 can have a first concentration of a first color pigmentation, while the second ink 12 can have a second concentration of the first color pigmentation. Similarly, the third ink 13 can have a first concentration of second color pigmentation, while the fourth ink 14 can have a second concentration of the second color pigmentation.

Stated in an alternative manner, the first ink 11 can be a first color saturation of a first color hue, while the second ink 12 can be a second color saturation of the first color hue. Likewise, the third ink 13 can be a first color saturation of a second color hue, while the fourth ink 14 can be a second color saturation of the second color hue. In such an instance, by way of example only, the first color pigmentation, or second color hue, can be cyan, while the second color pigmentation, or second color hue, can be magenta.

Furthermore, the first concentration, or first color saturation, can be relatively heavy, and the second concentration, or second color saturation, can be relatively light with respect to one another. In this manner, by way of example only, the first ink 11 can be regular cyan, and the second ink 12 can be light cyan. Similarly and also by way of example only, the third ink 13 can thus be regular magenta, and the fourth ink 14 can be light magenta.

It is understood that the terms "first concentration," "first color saturation," "second color concentration," and "second color saturation" are relative to one another only with regard to a given color. That is, for example, the first color saturation of the first color can be a different color saturation than the first color saturation of the second color, and so on. Also, as is mentioned above with regard to the prior art, the use of light cyan ink and light magenta ink in place of regular cyan ink and regular magenta ink, respectively, can provide beneficial results with regard to the production of images. This point can be appreciated with respect to the discussion below of the various embodiments of the invention.

It is seen, with continued reference to FIG. 2, that at least one ink nozzle orifice 201, 202, 203, 204 can be defined on the print head 120. That is, at least a first ink nozzle orifice 201 can be defined on the print head 120, while a second ink nozzle orifice 202 can also be defined on the print head. Likewise, a third ink nozzle orifice 203 can be defined on the print head 120, and a fourth ink nozzle orifice 204 can also be defined on the print head. Each ink nozzle orifice 201, 202, 203, 204 can be defined as a small hole through which an associated ink can be selectively projected onto a sheet of media (not shown), or the like, to produce an image.

That is, as is explained below in greater detail, the ink pen 200 can be configured such that a given ink, such as one or more of the inks 11, 12, 13, 14, 15, 16, can flow from its associated ink reservoir, such as one or more of the ink reservoirs 101, 102, 103, 104, 105, 106, to an associated ink nozzle orifice, such as one or more of the ink nozzle orifices 201, 202, 203, 204, so as to be projected therefrom and onto a sheet of media, or the like, for producing an image. The generally nature of such a process of producing an image is known in the art.

A plurality of at least the first ink nozzle orifices 201 can be defined on the print head 120. A plurality of the second ink nozzle orifices 202 can also be defined on the print head 120, as can also be the case with regard to the third ink nozzle orifice 203 and the fourth ink nozzle orifice 204, as is depicted. The ink pen 200 can also include an orifice plate 220 that can be operatively supported on the print head 120. The first ink nozzle orifice 201 can be defined through the orifice plate 220. Likewise, the second ink nozzle orifice 202 can be defined through the orifice plate 220, as can the third ink nozzle orifice and/or the fourth ink nozzle orifice 204.

Still referring to FIG. 2, the inkjet pen 200 can include a first ink passage 231 that can be defined in the body 110. The term "passage" as used herein is intended to include any means of containingly conveying ink from one location to another, such as by way of a small tube, duct, or capillary, for example. Thus, the first ink passage 231 is configured to containingly convey ink from the first ink reservoir 101 to the print head 120. More specifically, the first ink passage 231 can be configured to convey the first ink 11 from the first ink reservoir 101 to the first ink orifice 201.

As is seen, the inkjet pen 200 also can include a second ink passage 232 that can be defined in the body 110. The second ink passage 232 is configured to containingly convey ink from the second ink reservoir 102 to the print head 120. More specifically, however, the second ink passage 232 can be configured to containingly convey the second ink 12 from the second ink reservoir 102 to the first ink nozzle orifice 11.

The inkjet pen 200 can also include a third ink passage 233, and can further include a fourth ink passage 234. Likewise, a fifth ink passage 235 and a sixth ink passage 236 can also be included in the inkjet pen 200. The third ink passage 233, the fourth ink passage, the fifth ink passage 235, and the sixth ink passage 236 can each be configured in manners similar to those of the first ink passage 231 and the second ink passage 232 as described above. That is, the third ink passage 233 is configured to containingly convey ink from the third ink reservoir 103 to the print head 120, and more specifically, can be configured to containingly convey the third ink 13 from the third ink reservoir 103 to the second ink nozzle orifice 203.

Similarly, the fourth ink passage 234 is configured to containingly convey ink from the fourth ink reservoir 104 to the print head 120, and, more specifically, can be configured to containingly convey the fourth ink 14 from the fourth ink reservoir 104 to the second ink nozzle orifice. In like manners, the fifth ink passage 235 can be configured to containingly convey the fifth ink 15 from the fifth ink reservoir 105 to the third ink nozzle orifice 203, and the sixth ink passage 236 can be configured to containingly convey the sixth ink 16 from the sixth ink reservoir 106 to the fourth ink nozzle orifice 204.

From a study of FIG. 2, it is seen that the first ink passage 231 and the second ink passage 232 can be coincidental, or coexistent, with respect to one another, at least for respective portions thereof. That is, at least a portion of the first ink passage 231 and at least a portion of the second ink passage 232 can be integrated into a single passage, as is depicted. However, it is understood that the first ink passage 231 and the second ink passage 232 can, in the alternative, be completely separate from one another. Also, the third ink passage 233 and the fourth ink passage 234 can similarly be coincidental, or coexistent, with respect to one another, at least for respective portions thereof. Similarly, the third ink passage 233 and the fourth ink passage 234 can, alternatively, be completely separate from one another.

The inkjet pen 200 can include at least one valve that can be operatively supported by the body 110. The term "valve" as used herein is intended to encompass conventional valves as well as any other device or combination of devices that can be employed for controlling the flow of a liquid along a passage, including those flow control devices generally referred to in the art as Micro Electro Mechanical Systems, or "MEMS" valves. MEMS valves can be particularly well-suited for the application at hand.

Furthermore, although for illustrative purposes certain valves are described herein as "two-way valves" or "three-way valves," it is understood that when the term "valve" is used herein without a specific modifier, that term is intended to encompass any type of flow control device including a two-way valve, and/or a three-way valve, and/or a pair of two-way valves which can be configured to function substantially in the manner of a three-way valve.

With reference to FIG. 2, the inkjet pen 200 can include a first valve 241, and can also include a second valve 242. The first valve 241 and/or the second valve 242 can be operatively supported by the body 110. The first valve 241 can be configured to at least control the flow of the first ink 11 from the first ink reservoir 101 to the print head 120. Alternatively, the first valve 241 can be configured to control the flow of the first ink 11 from the first ink reservoir 101 to the print head 120, and to control the flow of the second ink 12 from the second ink reservoir 102 to the print head.

That is, the first valve 241 can be a three-way valve that is configured to be operated, or switched, between a first position and a second position, wherein, when in the, first position, the first valve allows the first ink 11 to flow from the first ink reservoir 101 to the print head 120, and more specifically, to the first ink nozzle orifice 201. Additionally, the first valve 241 can be configured such that, when in the first position, the flow of the second ink 12 from the second ink reservoir 102 is substantially blocked.

Alternately, the first valve 241 can be configured so that, when the first valve is a three-way valve and is in the second position, the first valve allows the second ink 12 to flow from the second ink reservoir 102 to the print head 120, and more specifically, to the first ink nozzle orifice 201. Additionally, the first valve 241 can be configured such that, when in the second position, the flow of the first ink 11 from the first ink reservoir 101 is substantially blocked. In this manner, the first ink reservoir 101 and the second ink reservoir 102 are selectively connectible in fluidic communication with the print head 120, and more specifically, with the first ink nozzle orifice.

In other words, the first ink reservoir 101 and the second ink reservoir 102 can be connected in fluidic communication with the print head 120, and more specifically, with the first ink nozzle orifice 201, wherein the flow of the first ink 11 from the first ink reservoir to the first ink nozzle orifice 201, and the flow of the second ink 12 from the second ink reservoir 102 to the first ink nozzle orifice, can be selectively controlled in mutual exclusion with respect to one another.

That is, by way of the first valve 241 or other such flow control means, either the first ink 11 flows to the print head 120, or the second ink 12 flows to the print head, depending upon the position, or setting, of the first valve or other such control means. Stated yet another way, the first valve 241, or other such flow control means, can be configured to be selectively operated so as to allow either the first ink 11 or the second ink 12 to flow to the print head 120, and more specifically to the first ink nozzle orifice 101, but not at the same time.

If the inkjet pen 200 includes the third ink reservoir 103 and the fourth ink reservoir 104, as well as the second valve 242, then the second valve can be configured to be operated in a manner similar to that of the first valve 241 as described above. That is, the second valve 241 can be configured to at least selectively control the flow of the third ink 13 from the third ink reservoir 103 to the print head 120, and more specifically to the second ink nozzle orifice.

The second valve 242 can be a three-way valve that is configured to be operated, or switched, between a first position and a second position, wherein, when in the first position, the second valve allows the third ink 13 to flow from the third ink reservoir 103 to the print head 120, and more specifically, to the second ink nozzle orifice 202. Additionally, the second valve 242 can be configured such that, when in the first position, the flow of the fourth ink 14 from the fourth ink reservoir 104 is substantially blocked.

Alternately, when the second valve 242 is a three-way valve and is in the second position, the second valve can be configured so as to allow the fourth ink 14 to flow from the fourth ink reservoir 104 to the print head 120, and more specifically to the second ink nozzle orifice 202. Additionally, the second valve 242 can be configured such that, when in the second position, the flow of the third ink 13 from the third ink reservoir 103 is substantially blocked. In this manner, the third ink reservoir 103 and the fourth ink reservoir 104 can be selectively connectible in fluidic communication with the print head 120, and more specifically, with the second ink nozzle orifice 201.

In other words, the third ink reservoir 103 and the fourth ink reservoir 104 can be connected in fluidic communication with the print head 120, and more specifically with the second ink nozzle orifice 202, wherein the flow of the third ink 13 from the third ink reservoir to the second ink nozzle orifice 202, and the flow of the fourth ink 14 from the fourth ink reservoir 104 to the second ink nozzle orifice, can be selectively controlled in mutual exclusion with respect to one another.

That is, by way of the second valve 242, or other such flow control means, either the third ink 13 flows to the print head 120, or the fourth ink 14 flows to the print head, depending upon the position, or setting, of the second valve or other such control means. Stated yet another way, the second valve 241, or other such flow control means, can be configured to be selectively operated so as to allow either the third ink 13 or the fourth ink 14 to flow to the print head 120, and more specifically to the second ink nozzle orifice 102, but not at the same time.

However, it is understood that other configurations of the first valve 241 and the second valve 242 are contemplated in accordance with various alternative embodiments of the invention that are not specifically illustrated herein. For example, a pair of two-way valves can be employed so as to obtain an operative result to that can be obtained from employing a three-way valve as in the specific illustrative example explained above and depicted in FIG. 2.

Specifically, by way of example only, the first valve 241 can be a two-way valve that is operatively located along the first passage 231 between the first ink reservoir 101 and the print head 120. Likewise the second valve 242 can also be a two-way valve that is operatively located along the second passage 232 between the second ink reservoir 102 and the print head 120. Each of the first and second valves can be configured so as to be operated between an "off" position, or setting, and an "on" position, or setting.

In this manner, the first valve 241 can be set to the "on" position, while at the same time, the second valve 242 can be set to the "off" position. When the first valve 241 and the second valve 242 are so positioned, the first ink 11 can be allowed to flow from the first ink reservoir 101 to the print head 120, and more specifically, to the first ink nozzle orifice 201, to the mutual exclusion of the second ink 12, the flow of which can be blocked by the second valve.

Alternately, the first valve 241 can be set to the "off" position, while at the same time, the second valve 242 can be set to the "on" position. When the first valve 241 and the second valve 242 are so positioned, the second ink 12 can be allowed to flow from the second ink reservoir 102 to the print head 120, and more specifically, to the first ink nozzle orifice 201, to the mutual exclusion of the first ink 11, the flow of which can be blocked by the first valve.

Figure 3:
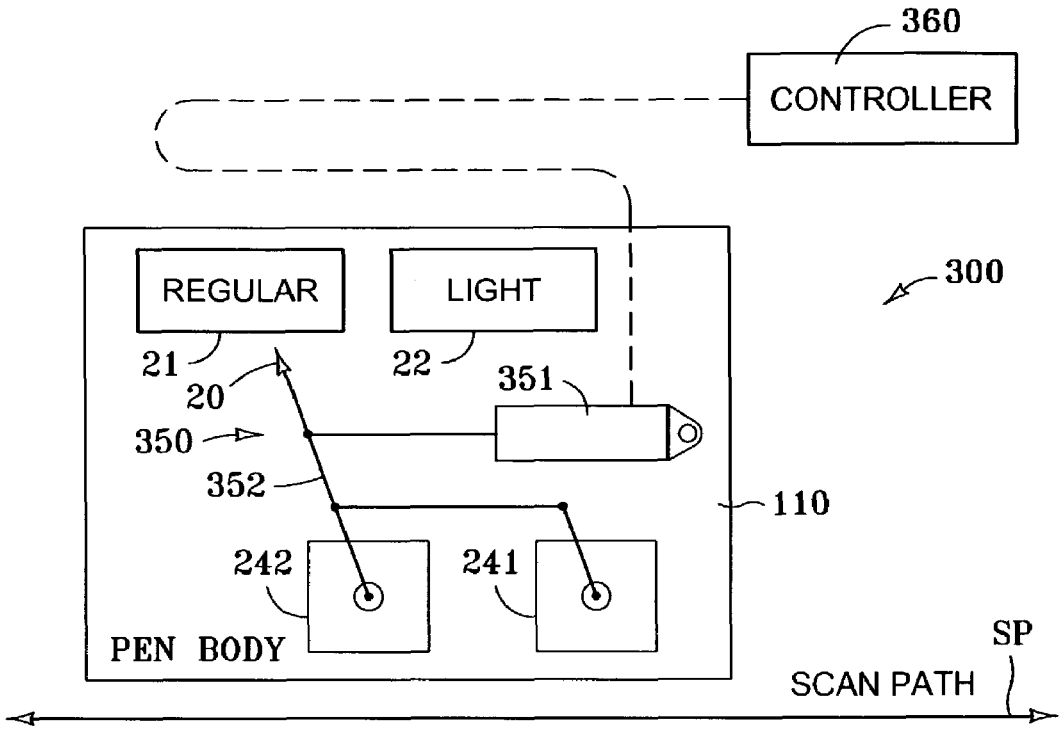
FIG. 3 is a schematic diagram in which an inkjet pen is depicted in accordance with yet another embodiment of the present invention.

Turning now to FIG. 3, a schematic diagram is shown in which an inkjet pen 300 is depicted in accordance with yet another embodiment of the present invention. The inkjet pen 300 can be substantially similar in many respects to the inkjet pens 100 and 200 which are described above with respect to FIGS. 1 and 2, respectively. However, it is understood that, for purposes of clarity, some components of the inkjet pen 300 are omitted from FIG. 3. For example, the inkjet pen 300 includes a body 110. The pen body 110 can be substantially similar to the body 110 of either the inkjet pen 100 and/or the inkjet pen 200 as described above.

That is, the body 110 of the inkjet pen 300 defines at least two ink reservoirs which are not shown in the interest of clarity. The inkjet pen 300 can also include a print head that is not shown, but which can be similar to the print head 120 described above with respect to the inkjet pens 100 and 200 and which is shown in FIGS. 1 and 2, respectively. The inkjet pen 300 can include other such components which are not specifically shown in FIG. 3. Such components include ink nozzle orifices, orifice plates, and ink passages which are discussed above with respect to the inkjet pens 100 and 200.

With continued reference to FIG. 3, the inkjet pen 300 includes at least one valve, and more specifically, can include a first valve 241, and can also include a second valve 242. The valves 241, 242 are described above with respect to the inkjet pen 200. That is, the valves 241, 242 are preferably configured to each control the flow of an associated ink from a respective ink reservoir (not shown) to the print head (also not shown).

As is described above with respect to the inkjet pen 200, each of the valves 241, 242 can be configured to be operated, or switched, between at least two positions, or settings. As is explained above, these setting can include, for example, "on" and "off" positions, in the case of two-way valves, or "regular" and "light" settings in the case of three-way valves. It is understood that these are only two examples of possible types of valve settings, or positions, and that other types of valve settings are possible in accordance with various embodiments of the present invention.

The inkjet pen 300 can include a switching mechanism 350. The switching mechanism 350 is configured to facilitate the selective switching, or operating, of one or more of the valves 241, 242 between two or more settings, or positions. By way of illustrative example only, the first valve 241 and the second valve 242 are depicted in FIG. 3 as configured to be switched between a "light" position and a "regular" position. That is, as a study of FIG. 3 reveals, a pointer 20 is shown to be connected to the switching mechanism 350, wherein the pointer is configured to point to one of a first tag 21 and a second tag 22.

By way of example only, the first tag 21 can bear a label such as "regular" while the second tag can bear a label such as "light." In this manner, the current position, or setting, or the first valve 241, and/or the second valve 242, can be indicated by way of the pointer 20, the first tag 21, and the second tag 22. It is understood that the pointer 20, the first tag 21, and the second tag 22, are included in FIG. 3 primarily for illustrative purposes. That is, an actual prototype of the inkjet pen 300 need not include the pointer 20, or the first tag 21, or the second tag 22.

Figure 4:
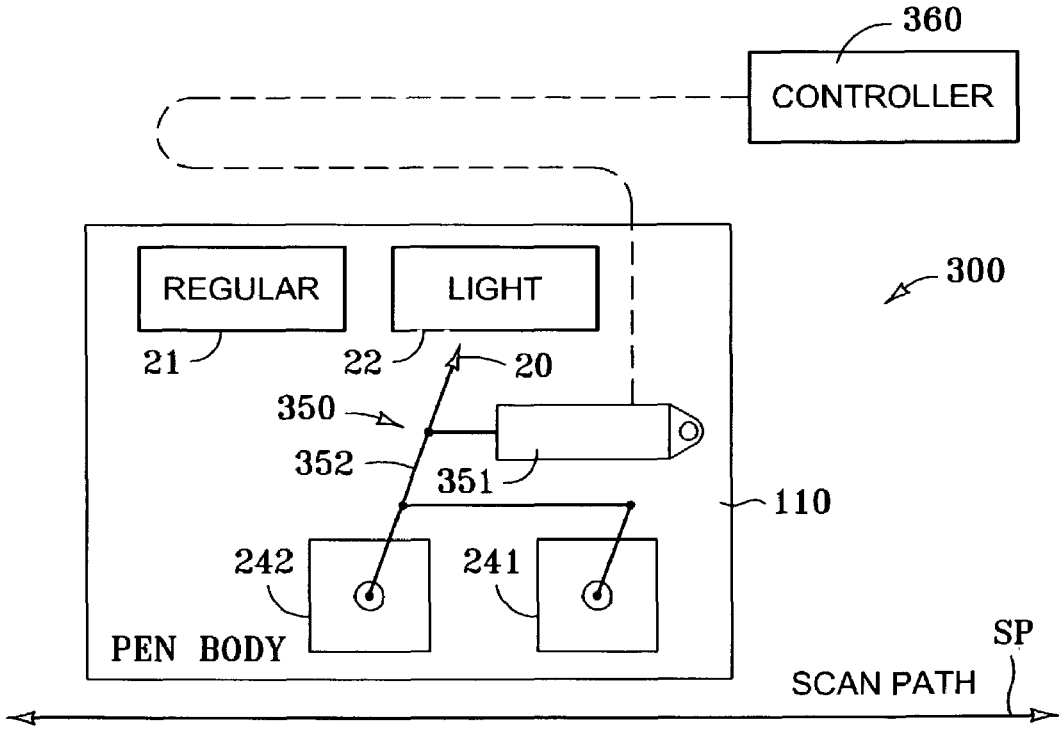
FIG. 4 is a schematic diagram of the inkjet pen depicted in FIG. 3, wherein the inkjet pen is depicted in an alternative operational mode.

With reference now to FIG. 4, another schematic diagram of the inkjet pen 300 is shown, wherein the inkjet pen 300 is depicted in an alternative operational mode. That is, the first valve 241 and the second valve 242 are shown in FIG. 3 as being in a first operational position, while in FIG. 4, the first valve and second valve are shown to be in a second operational position. With reference to both FIGS. 3 and 4, and as indicated by the pointer 20, as well as the first tag 21 and the second tag 22, the first position can be a "regular" position, wherein regular colored ink is allowed to flow, and the second position can be a "light" position, wherein light colored ink is allowed to flow.

As is also seen, the switching mechanism 350 can include an actuator 351. The actuator 351 is configured to move the first valve 241 and/or the second valve 242 from one position, or setting, to another position, or setting. The actuator 351 can be any device which can be selectively activated to accomplish the movement of the first valve 241, and/or the second valve 242 between respective positions, or settings. For example, the actuator 351 can be a solenoid, or an pneumatic cylinder, or a hydraulic cylinder, or a biasing member such as a spring or the like. The actuator 351 can be operatively supported by the body 110 as is shown.

A controller 360 can also be included in the inkjet pen 300. The controller 360 is configured to selectively control the activation of the actuator 351, and thus is configured to selectively control the positioning of the first valve 241, and/or the second valve 242. The controller 360 can be connected in signal communicable linkage with the actuator 351, whereby control signals can be transmitted by the controller and can also be received by the actuator. The controller 360 can also be configured to receive feedback signals from the actuator 351. The signal communicable linkage between the actuator 351 and the controller 360 is preferably by flexible cable, or by wireless means, or the like, of which various forms are known in the art.

The controller 360 can be supported on the pen body 110, although the controller can be remotely supported as is depicted. That is, the controller 360 can be satisfactorily operatively supported on an object other than the pen body 110, such as the chassis of an inkjet printer (not shown) or the like. Furthermore, the controller 360 can be the controller of an inkjet printer, or the like, in which the inkjet pen 300 can be operatively supported. In this manner, the controller 360 can be configured to control the activation of the actuator 351, and thus the positioning of the first valve 241, and/or the second valve 242, while the pen 300 is traversing along a scan path SP, for example.

The switching mechanism 350 can include a linkage 352 that can be operatively connected to at least the first valve 241, as well as to the second valve 242. The linkage 352 can also be operatively connected with the actuator 351 as is depicted. That is, the linkage 352 can be operatively connected between the actuator 351 and at least the first valve 241, and also the second valve 242, as is depicted. In this manner, the linkage 352 can be configured to transmit movement, and/or mechanical power from the actuator 351 to at least the first valve 241, and preferably also to the second valve 342, for the selective positioning thereof.

As is explained above, the first valve 241 and the second valve 242 can each be three-way valves, and can be selectively positionable between, for example, a "regular" position, and a "light" position. Alternatively, by way of example only, the first valve 241 and the second valve 242 can each be two-way valves that are each selectively positionable between an "on" position and an "off" position. In such a case, the first valve 241 can be in the "on" position when the second valve 242 is in the "off" position, and vice versa, as is explained above with respect to the inkjet pen 200. That is, in such a case, by way of example only, the first tag 21 could read, "First-On, Second-Off," and the second tag 22 could read, "First-Off, Second-On."

Figure 5:
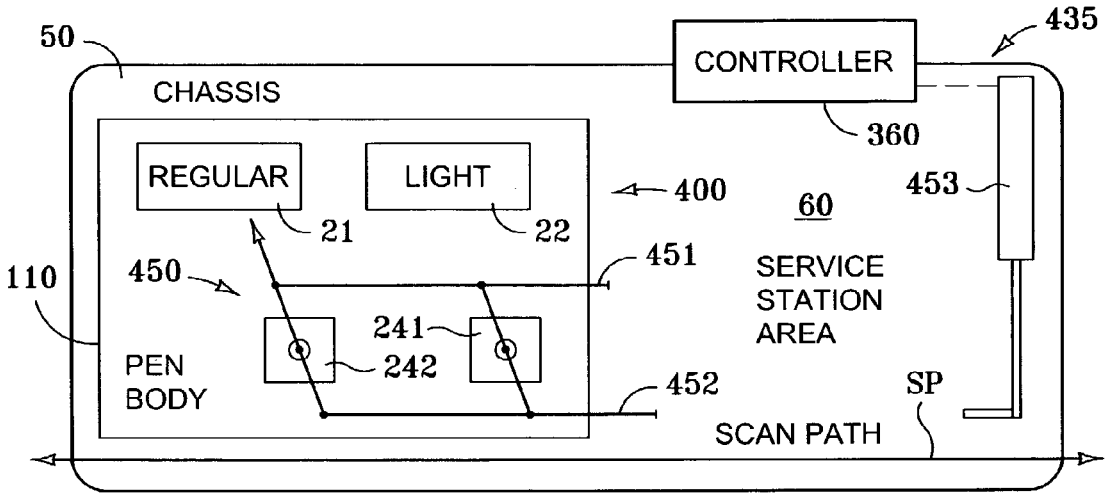
FIG. 5 is a schematic diagram in which an inkjet pen is depicted in accordance with still yet another embodiment of the present invention.

Turning now to FIG. 5, a schematic diagram is shown in which an inkjet pen 400 is depicted in accordance with still yet another embodiment of the present invention. The inkjet pen 400 can be configured in a manner substantially similar to that of the inkjet pen 300 which is discussed above and which is depicted in FIGS. 3 and 4. That is, the inkjet pen 400 includes a pen body 110, as well as at least one valve, such as the first valve 241. However, the inkjet pen 400 can include a plurality of valves, such as the first valve 241 and the second valve 242.

The inkjet pen 400 can also include other components and features such as a print head (not shown), as well as a plurality of ink reservoirs (not shown), and/or various passages and the like as discussed above with respect to the previously described embodiments 100, 200, and 300. However, as is also discussed above with respect to the inkjet pen 300, various components and/or features of the inkjet pen 400, as depicted in FIG. 5, have been omitted for the sake of clarity. As is further discussed above with respect to the inkjet pen 300, a pointer 20 as well as a first tag 21 and a second tag 22 have been included in FIG. 5, as well as following figures, for illustrative purposes.

With continued reference to FIG. 5, the inkjet pen 400 can be configured to be operatively supported on a chassis 50, or the like, relative to which the pen body 110, along with other components and features supported thereby, is movable along a scan path SP. In other words, the inkjet pen 400 can be configured to be movably supported by a chassis 50, or the like, which can be, for example, the chassis of an inkjet printer. The pen body 110 can be movable relative to the chassis 50 along the scan path SP by way of a traversing mechanism (not shown), or the like, in facilitation of the production of images as is discussed above with respect to the prior art.

A service station area 60 can be defined on the chassis 50. The service station area 60 can be an area into which the pen body 110 can be moved for the performance of one or more service operations thereon, or for storage thereof when not operating to produce images. The concept of a service station area is known in the art. When the inkjet pen 400 is traversing, or moving, along the scan path SP for the projection of ink droplets (not shown) onto a sheet of media or the like, the inkjet pen does not typically enter the service station area 60. However, when a given service operation is to be performed on the inkjet pen 400, the inkjet pen can then be moved into the service station area.

The inkjet pen 400 can include a linkage 450 that can be operatively connected to the first valve 241, and alternatively, can be operatively connected to both the first valve 241 and to the second valve 242. The linkage 450 can include a first contact element 451, and can also include a second contact element 452. The basic operational function of the linkage 450 can be similar to that of the linkage 350 which is explained above with respect to the inkjet pen 300. That is, the linkage 450 can be configured to facilitate the operation of the first valve 241, and alternatively, the operation of both the first valve 241 and the second valve 242.

More specifically, the linkage 450 can be configured to move along with the first valve 241, and preferably, the first valve and the second valve 242, between a first position, or setting, and a second position, or setting. As is depicted in FIG. 5, the first valve 241, the second valve 242, and the linkage 450 are located in the first position. By way of example only, and as indicated by the pointer 20 along with the first tag 21 and the second tag 22, the first position can be a "regular" setting of both the first valve 241 and/or the second valve 242.

Still referring to FIG. 5, the inkjet pen 400 can be configured to move relative to an object 435. The object 435 can include, for example, the actuator 351 as is depicted. The actuator 351 is described above with respect to the inkjet pen 300. The controller 360, which is also described above with respect to the inkjet pen 300, can also be included in the object and can be employed to control the movement of the actuator 351 when the object is in the form of an actuator.

The object 435, and more specifically, the actuator 351, can be supported by the chassis 50 so that the pen body 110, when moving along the scan path SP, moves relative to the object. The object 435, such as for example when the actuator 351 is included therein, can be configured to move between a first position and a second position, as is described below in greater detail. By way of illustrative example only, the actuator 351 is depicted in FIG. 5 as being in the second position.

As a study of FIG. 5 reveals, the object 435, and more specifically the actuator 351, along with the pen body 110 and the linkage 450, can be configured in a manner such that the movement of the pen body 110 along the scan path SP can result in the impingement of the linkage 450 and more specifically either the first contact member 451 and/or the second contact member 452, against the object 435, and/or against the actuator 351. However, the impingement of the linkage 450 against the object 435 can generally occur only when the pen body 110 enters the service station area 60, as is depicted.

Figure 6:
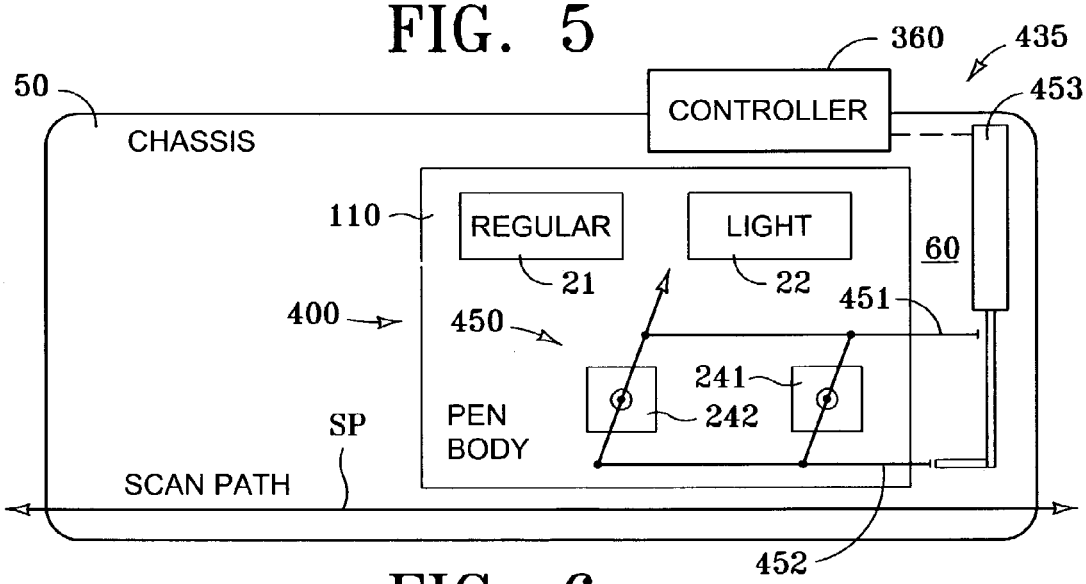
FIG. 6 is schematic diagram of the inkjet pen depicted in FIG. 5, wherein the ink-jet pen is depicted in an alternative operational mode.

Now turning to FIG. 6, another schematic diagram is shown of the inkjet pen 400 which is depicted in FIG. 5, wherein the inkjet pen is depicted in an alternative operational mode. That is, the pen body 110 is shown to have moved toward the object 435 along the scan path SP so as to cause the linkage 450 to impinge upon the object. More specifically, as a result of the pen body 110 entering the service station area 60 and moving toward the object 435 with the actuator 351 in the second position, the second contact element 452 is shown to have impinged upon the object, thus causing the linkage 450, as well as the first valve 241 and the second valve 242, to move from the first position to the second position.

Figure 7:
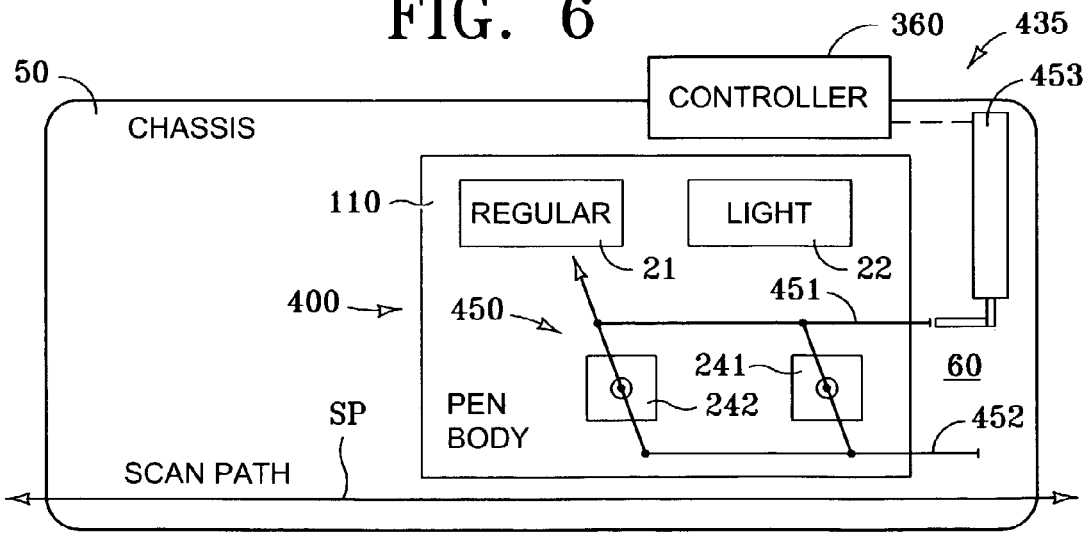
FIG. 7 is schematic diagram of the inkjet pen depicted in FIG. 5, wherein the ink-jet pen is depicted in an yet alternative operational mode.

With reference now to FIG. 7, yet another schematic diagram is shown of the inkjet pen 400 which is depicted in FIGS. 5 and 6. In FIG. 7, the body 110 is shown to have moved out of the service station area 60, and then back into the service station area, and the actuator 351 is shown to have moved from the second position to the first position while the body was out of the service station area. That is, the body 110 is shown to have moved into the service station area 60 and toward the object 435 while the actuator 351 is in the first position, thereby causing the first contact member 451 to impinge against the object, which in turn, has caused the linkage 450, the first valve 241, and the second valve 242, to move from the second position to the first position.

In this manner, the position of the actuator 351, as well as the movement of the pen body 110, can be controlled to selectively position and/or reposition the first valve 241, and/or the second valve 242. That is, by way of example only and with reference to FIGS. 5, 6, and 7, regular colored ink can be made to flow by first causing the actuator 351 to move to the first position, and then by causing the pen body 110 to move against the object 435, thus causing the linkage 450, the first valve 241, and the second valve 242, to move to the first position.

Furthermore, also by way of example only, light colored ink can be made to flow by first causing the actuator 351 to move to the second position, and then by causing the pen body 110 to move against the object 435, thus causing the linkage 450, the first valve 241, and the second valve 242 to move to the second position.

In accordance with still another embodiment of the present invention, a method of providing liquid ink for an imaging process includes providing an inkjet pen that includes a first ink reservoir and a second ink reservoir. Such an inkjet pen can be, for example, similar to the inkjet pen 100 described above. The method includes providing a first ink with a first color saturation of a given color hue, and placing the first ink into the first ink reservoir. Also provided is a second ink with a second color saturation of the given color hue. The second ink is placed into the second ink reservoir.

The method can further include providing an ink nozzle orifice, and directing flow of the first ink from the first ink reservoir to the ink nozzle orifice while blocking flow of the second ink from the second ink reservoir to the ink nozzle orifice. This configuration can be switched by blocking the flow of the first ink from the first ink reservoir to the ink nozzle orifice while directing flow of the second ink from the second ink reservoir to the ink nozzle orifice.

Also in accordance with the method, the given color hue can be a first color hue. In such a case, a third ink reservoir can be provided, as can a fourth ink reservoir. Accordingly, the method can include placing a third ink with a first color saturation of second color hue into the third ink reservoir, and placing a fourth ink with a second color saturation of the second color hue into the fourth ink reservoir.

A second ink nozzle orifice can be provided, and the third ink can be directed to the second ink nozzle orifice from the third ink reservoir while the fourth ink is blocked from flowing from the fourth ink reservoir to the second ink nozzle orifice. Likewise, the third ink can be blocked from flowing from the third ink reservoir to the second ink nozzle orifice while the fourth ink is directed to flow from the fourth ink reservoir to the second ink nozzle orifice.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An inkjet pen comprising:

a body that defines therein a first ink reservoir, a second ink reservoir, a third ink reservoir, and a fourth ink reservoir;

a print head operatively supported by the body;

a first ink nozzle orifice defined on the print head;

a second ink nozzle orifice defined on the print head;

a first valve operatively supported by the body and configured to control the flow of a first ink from the first ink reservoir to the first ink nozzle orifice, control the flow of a second ink from the second ink reservoir to the first nozzle orifice; and a second valve operatively supported by the body and configured to control the flow of a third ink from the third ink reservoir to the second ink nozzle orifice, and control the flow of a fourth ink from the fourth ink reservoir to the second ink nozzle orifice, and wherein the first ink reservoir and the second ink reservoir are each selectively and mutually exclusively connectable in fluidic communication with the first ink nozzle orifice by way of the first valve, and the third ink reservoir and the fourth ink reservoir are each selectively and mutually exclusively connectable in fluidic communication with the second ink nozzle orifice by way of the second valve.

2. The inkjet pen of claim 1, and further comprising:

a quantity of the first ink contained within the first reservoir, wherein the first ink has a first concentration of a given color pigmentation; and, a quantity of the second ink contained in the second reservoir, wherein the second ink has a second concentration of the given color pigmentation.

3. The inkjet pen of claim 1, and further comprising:

a quantity of the first ink contained in the first reservoir, wherein the first ink is of a given color hue and a first color saturation; and, a quantity of the second ink contained in the second reservoir, wherein the second ink is of the given color hue and a second color saturation.

4. The inkjet pen of claim 1, and further comprising:

a quantity of the first ink contained within the first reservoir, wherein the first ink has a first concentration of a first color pigmentation;

a quantity of the second ink contained in the second reservoir, wherein the second ink has a second concentration of the first color pigmentation;

a quantity of the third ink contained within the third reservoir, wherein the third ink has a first concentration of a second color pigmentation; and, a quantity of the fourth ink contained in the fourth reservoir, wherein the fourth ink has a second concentration of the second color pigmentation.

5. The inkjet pen of claim 1, and further comprising an orifice plate supported by the print head, wherein the first ink nozzle orifice and the second ink nozzle orifice are defined in the orifice plate.

6. The inkjet pen of claim 1, and further comprising a switching mechanism configured to operate the first valve and the second valve.

7. The inkjet pen of claim 6, and wherein the switching mechanism comprises a linkage operatively connected to the first valve and to the second valve.

8. The inkjet pen of claim 7, and wherein the switching mechanism further comprises an actuator supported by the body and operatively connected to the linkage, wherein actuation of the actuator results in operation of the first three-way valve and the second three-way valve.

9. The inkjet pen of claim 7, wherein:

operation of the linkage results in operation of the first valve and of the second valve;

the inkjet pen is configured to be moved relative to an object; and, the linkage is configured to be operated by impingement thereof against the object as the result of movement of the inkjet pen relative thereto.

10. The inkjet pen of claim 9, and wherein:

the object comprises an actuator that is configured to move between a first position and a second position;

when the linkage impinges against the object when the actuator is in the first position, the resulting operation of the linkage causes:

the first valve to fluidly connect the first ink reservoir to the first ink nozzle orifice while fluidly blocking the second ink reservoir from the first ink nozzle orifice; and, the second valve to fluidly connect the third ink reservoir to the second ink nozzle orifice while fluidly blocking the fourth ink reservoir from the second ink nozzle orifice; and, when the linkage impinges against the object when the actuator is in the second position, the resulting operation of the linkage causes:

the first valve to fluidly connect the second ink reservoir to the first ink nozzle orifice while blocking the first ink reservoir from the first ink nozzle orifice; and, the second valve to fluidly connect the fourth ink reservoir to the second ink nozzle orifice while blocking the third ink reservoir from the second ink nozzle orifice.

* * * * *

UNITED STATES PATENT AND TRADEMARK OFFICE

CERTIFICATE OF CORRECTION

PATENT NO. : 7,033,012 B2
APPLICATION NO. : 10/356784
DATED : April 25, 2006
INVENTOR(S) : Ricardo G. Diaz-Felipe It is certified that error appears in the above-identified patent and that said Letters Patent is hereby corrected as shown below:

In column 2, line 50, delete “car” and insert -- can --, therefor.

Signed and Sealed this

Twenty-first Day of April, 2009

JOHN DOLL
*Acting Director of the United States Patent and Trademark Office*